US006564551B1

(12) United States Patent
Stock

(10) Patent No.: US 6,564,551 B1
(45) Date of Patent: May 20, 2003

(54) GAS EXPANSION APPARATUS FOR A SYSTEM FOR THE CONVERSION OF THERMAL ENERGY INTO MOTIVE ENERGY, IN PARTICULAR FOR A HOT-WATER MOTOR

(76) Inventor: Gerhard Stock, Friedenseiche 1, D-56850 Enkirch (DE)

( * ) Notice: Subject to any disclaimer, the term of this patent is extended or adjusted under 35 U.S.C. 154(b) by 0 days.

(21) Appl. No.: 09/914,766

(22) PCT Filed: Mar. 4, 2000

(86) PCT No.: PCT/DE00/00642

§ 371 (c)(1),
(2), (4) Date: Dec. 11, 2001

(87) PCT Pub. No.: WO00/53898

PCT Pub. Date: Sep. 14, 2000

(30) Foreign Application Priority Data

Mar. 5, 1999 (DE) ..... 199 09 611

(51) Int. Cl.[7] ..... F01B 29/08
(52) U.S. Cl. ..... 60/516; 60/530; 60/659

(58) Field of Search ..... 60/516, 530, 659

(56) References Cited

U.S. PATENT DOCUMENTS

| | | | | | |
|---|---|---|---|---|---|
| 3,932,995 | A | * | 1/1976 | Pecar | 60/531 |
| 3,967,450 | A | * | 7/1976 | Girardier | 60/657 |
| 4,107,928 | A | | 8/1978 | Kelly et al. | |
| 4,283,915 | A | | 8/1981 | McConnell et al. | |
| 4,545,207 | A | * | 10/1985 | Neary | 165/104.12 |
| 4,748,813 | A | * | 6/1988 | Ross et al. | 60/643 |
| 5,074,110 | A | | 12/1991 | Singh | |

FOREIGN PATENT DOCUMENTS

| | | |
|---|---|---|
| DE | 197 19 190 | 2/1999 |
| EP | 0 043 879 | 1/1982 |

* cited by examiner

*Primary Examiner*—Hoang Nguyen
(74) *Attorney, Agent, or Firm*—Venable, LLP; Robert Kinberg

(57) ABSTRACT

The invention relates to a gas expansion apparatus which is part of a system for the conversion of thermal energy into motor energy, especially for a hot-water motor.

7 Claims, 2 Drawing Sheets

GAS EXPANSION APPARATUS FOR A SYSTEM FOR THE CONVERSION OF THERMAL ENERGY INTO MOTIVE ENERGY, IN PARTICULAR FOR A HOT-WATER MOTOR

BACKGROUND OF THE INVENTION

The invention relates to a gas expansion apparatus which is part of a system for the conversion of thermal energy into motive energy, in particular for a hot-water motor, consisting of a closed pressure vessel which is filled with a gas or a gas mixture, which is operatively connected to the system via a displaceable piston (liquid displacement pump) and which has at least one upper injection orifice for hot and for cold water and a lower water outflow orifice (liquid outflow pipe).

Gases, when heated and expanded, convert a relatively large amount of heat into work, thus giving rise, in rapid processes, such as, for example, the Stirling process, to major losses due to dissipation, unfavorable piston control, heat and hunting losses, clearance volume effects, high regenerator resistance and high velocities.

U.S. Pat. No. 4,283,915 discloses a arrangement for the conversion of thermal energy into motive energy, which in each case comprises a feed for hot water and a feed for cold water, a specific temperature difference prevailing between the hot water and the cold water. The hot water and the cold water are conducted alternately through tubes of a heat exchanger, in order to expand and contract a working liquid. The work cycle is carried out below a boiling point of the working liquid. Nonreturn valves ensure a relatively high pressure for the actuation of the arrangement. In this case, the use of the heat exchanger proves to be a disadvantage, since such a tube heat exchanger, which involves a high technical outlay, has only greatly limited efficiency and, depending on the nature of the media flowing through and around it, is relatively susceptible to faults.

Moreover, DE 197 19 190 C2 discloses an arrangement for the conversion of thermal energy into electrical energy, which consists of a working circuit with a working fluid for driving a turbomachine and of a multiplicity of heat exchangers through which a cold medium and a hot medium flow alternately. In each of the heat exchangers is arranged an expansion element which expands and contracts as a function of the temperature of the medium and the temperature-induced expansions and contractions of which are supplied to the working circuit via a buffer store. For storing a force, each heat exchanger is assigned a buffer store designed as a spring, each spring being connected to the piston of a pressure cylinder, the working space of which is connected in each case by control valves, via suction and delivery lines, to a working oil circuit which drives a turbine having a generator. This arrangement has a relatively complex set-up, in particular because of the buffer stores designed as springs, and suffers from the disadvantages of a heat exchanger which were explained above.

Furthermore, EP 0 043 879 A1 discloses a gas expansion element, designed as a cylinder, for the conversion of thermal energy into motive energy. For the operative connection of the cylinder to the arrangement, a piston is mounted displaceably in the cylinder filled with air. The cylinder has an upper injection orifice for hot water and a controllable lower water outflow orifice.

SUMMARY OF THE INVENTION

The object of the invention is to provide a gas expansion apparatus of the type initially mentioned, by means of which a relatively high power output can be achieved at a low, technical outlay.

The object is achieved, according to the invention, in that

- the pressure vessel has an upper injection orifice for cold water,
- the lower water outflow orifice is arranged at the lower end of a sump which projects downward beyond the pressure vessel and which has a substantially smaller diameter than the pressure vessel, and
- the piston is designed as a liquid piston pump (liquid displacement pump) which is connected on the inlet side to the water outflow orifice of the pressure vessel, said orifice being assigned a water inflow of a working circuit, and on the outlet side to a water outflow of the working circuit.

These measures ensure that expansion and contraction of the same medium (gas) takes place into one and the same chamber of the gas expansion apparatus, with the result that the gas expansion apparatus is produced at a low technical outlay. The medium contracting during the supply of cold water and expanding during the supply of hot water therefore acts upon the piston designed as a liquid piston pump, without losses of a heat exchanger or the like occurring. At the same time, in order to heat the air or another gas in the pressure vessel, hot water is sprayed directly into the pressure vessel where it as far as possible immediately penetrates a gas to be expanded. The condensate is collected in the sump which prevents the gaseous medium from flowing out of the interior of the pressure vessel. Due to the relatively small diameter of the sump, with the latter at the same time having a relatively long length, the heat transmission between the interior of the pressure vessel and an outflow for the condensate or the outflowing condensate itself is reduced. Furthermore, the liquid piston pump is not subject to any frictional losses, with the result that the efficiency is increased, as compared with the use of a piston guided in a cylinder.

According to an advantageous embodiment of the invention, an injection orifice with a spray and atomizer nozzle directed into the interior of the pressure vessel is provided in each case for the hot water and the cold water. The spray and atomizer nozzle brings about a fine distribution of the injected hot or cold water in the pressure vessel and therefore a rapid penetration of the gas. Furthermore, the separate injection orifices having the associated atomizer nozzles ensure that, when cold water is injected, no residues of hot water enter the interior of the pressure vessel and, conversely, also no residues of cold water are introduced when hot water is being injected.

In order largely to prevent heat losses, preferably at least the inner wall of the pressure vessel consists of a material not absorbing heat or is coated with an insulating material.

For the relatively rapid downward discharge of the hot or cold water injected into the pressure vessel, expediently the inner wall of the pressure vessel consists of a water-repelling material or is coated with such a material.

For controlling the injection time of the hot or cold water, expediently the liquid piston pump is provided in each case with a level sensor for an upper and a lower level of the water within the liquid piston pump. After the upper level is reached, the injection of the hot water into the pressure vessel takes place by computer control, whereupon the gaseous medium in the pressure vessel expands and the level of the water within the liquid piston pump falls until the lower level is reached and the associated level sensor, by computer control, signals the injection of cold water for the contraction of the gaseous medium.

To prevent an undesirable pressure drop and to preset the direction of flow in the working circuit, preferably a non-return valve is inserted in each case into the water outflow and the water inflow.

Advantageously, the pressure vessel is designed to merge in a funnel-shaped manner in the sump or in the direction of the water outflow. This shape is conducive to a rapid downward discharge of the injected hot or cold water.

It goes without saying that the features mentioned above and those still to be explained below can be used not only in the combination specified in each case, but also in other combinations, without departing from the scope of the present invention.

The gas expansion apparatus presented in this application for letters patent comprises a gas expansion apparatus including a closed hollow pressure vessel, a liquid displacement pump having a gas/liquid interface, and a working circuit. An injection nozzle is located at an upper end of the pressure vessel for injection of a first liquid and of a second liquid into the pressure vessel, the first liquid being at a higher temperature than the second liquid. A sump is located at a lower end of the pressure vessel, and the sump has a substantially smaller diameter than the diameter of the pressure vessel and projects downward from the pressure vessel. A controllable liquid outflow pipe is located at the lower end of the sump. A liquid displacement pump has a gas/liquid interface and an inlet and an outlet; the inlet of the pump is connected to the controllable liquid outflow pipe. The working circuit drives a thermal energy conversion device, and has a liquid inflow connected between the controllable liquid outflow pipe and the thermal energy conversion device; the working circuit also has a liquid outflow connected between the outlet of the pump and the thermal energy conversion device. Injection of the first liquid into the pressure vessel causes gas contained within the pressure vessel to expand, driving the gas/liquid interface of the pump in a first direction to increase pressure on the liquid in the working circuit; the pressure on the liquid in the working circuit drives the thermal energy conversion device. Injection of the second liquid into the pressure vessel causes the gas contained within the pressure vessel to contract, displacing the gas/liquid interface in a second direction opposite to the first direction.

The injection nozzle may be a spray and atomizer nozzle. The inner wall of the pressure vessel may comprise a material that does not absorb heat or a coating of insulating material. The inner wall of the pressure vessel may comprise a liquid-repelling material or a coating of liquid-repelling material. The liquid piston pump may be provided with level sensors for detecting a lower level of liquid at a lower end position within the liquid displacement pump and for detecting an upper level of liquid at an upper end position within the liquid displacement pump. A first working circuit non-return valve may be located within the liquid outflow of the working circuit and a second working circuit nonreturn valve may be located within the liquid inflow of the working circuit. The lower portion of the pressure vessel may have the form of a funnel such that it merges into the sump.

BRIEF DESCRIPTION OF THE DRAWINGS

The invention is explained in more detail below by means of two exemplary embodiments, with reference to the accompanying drawings in which.

Figure 1:
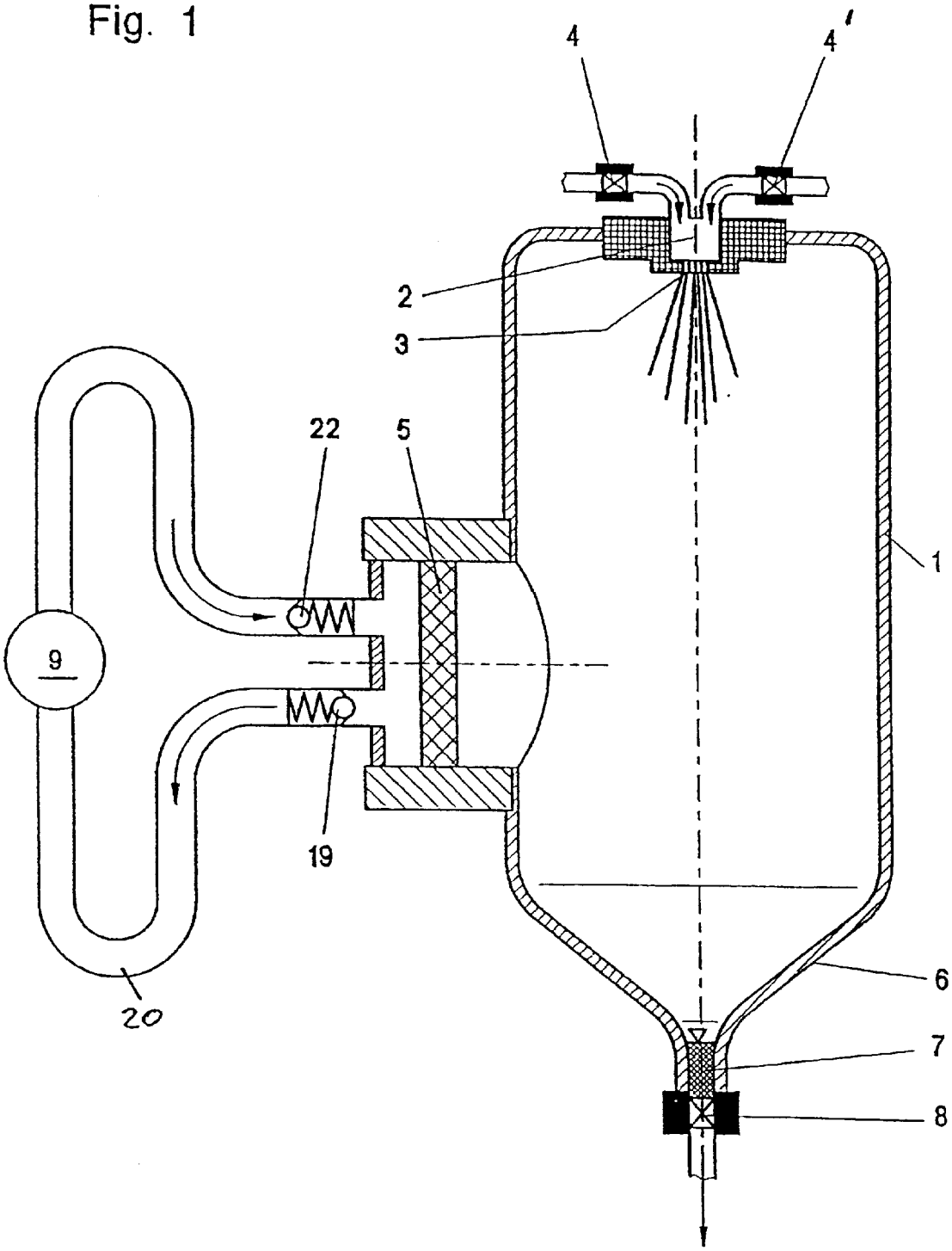
FIG. 1 shows a section through a gas expansion apparatus according to the invention, with associated components.

An essentially cylindrical to spherical pressure vessel 1 according to FIG. 1 has, on its top side, an injection orifice 2 which has a spray and atomizer nozzle 3 directed into the interior of the pressure vessel. Hot water or cold water can be injected alternately into the pressure vessel 1 via associated valves 4 and 4'. A liquid other than water can be used as well.

DETAILED DESCRIPTION OF THE INVENTION

The pressure vessel 1 filled with a gas or a gas mixture is connected in its wall to a displaceable piston 5 which makes the connection to an arrangement 9 for the conversion of motion of the piston to motive energy at a location different from the location of said piston. The system illustrated in FIG. 1 could function as a hot water motor.

The pressure vessel 1 is of funnel-shaped design at its lower portion 6 which merges in a sump 7 which projects downward beyond the pressure vessel 1 and which has a controllable lower water outflow orifice 8 at its lower end.

In order to heat the air or other gases of the pressure vessel 1, hot water is injected directly by way of the associated valve 4 and the injection orifice 2, via the spray nozzle 3, into the pressure vessel where it largely immediately penetrates the gas to be expanded. The pressure vessel 1 is insulated at least on the inside, otherwise over its entire wall, in such a way that it does not absorb any heat in the material. Moreover, the inner wall is water-repelling, in order to discharge the introduced water rapidly downward after cooling.

The air heats up with the injection of the hot water, expands and, via the displaceable piston 5, performs work which is supplied to a working circuit 20, not illustrated in any more detail, of the arrangement 9 for the conversion of the thermal energy. The spraying of the hot water takes place, in this case, in such a way that the heat or cold carried in the water can spread out immediately in the vessel. This ensures a high clock frequency (approximately one cyclic process in one to three seconds).

After the pressure rise and, after piston displacement, the corresponding pressure drop in the pressure vessel, and after corresponding cooling, the water falls out and settles downward in the sump 7. The controllable lower water outflow orifice 8, by computer control, discharges there only so much water that the sump 7 is prevented from becoming dry and, consequently, an outflow of gas/air is avoided. The sump 7 is kept long and narrow, so that no heat transmission into the outflowing water can take place.

The quantity of water required for heating is very small. Thus, 9.1 kJ in 22 g of water is sufficient for heating 100 liters of air from 0° C. to 100° C. In this case, a useful work of 3.6 kJ becomes available (approximately 40% efficiency when air is used).

For the cooling and subsequent contraction of the air (gas) in the pressure vessel 1, cold water is injected. A negative pressure is generated, so that the displaceable piston 5 returns to the initial position again. The efficiency can be increased by means of special gases or gas mixtures.

Figure 2:
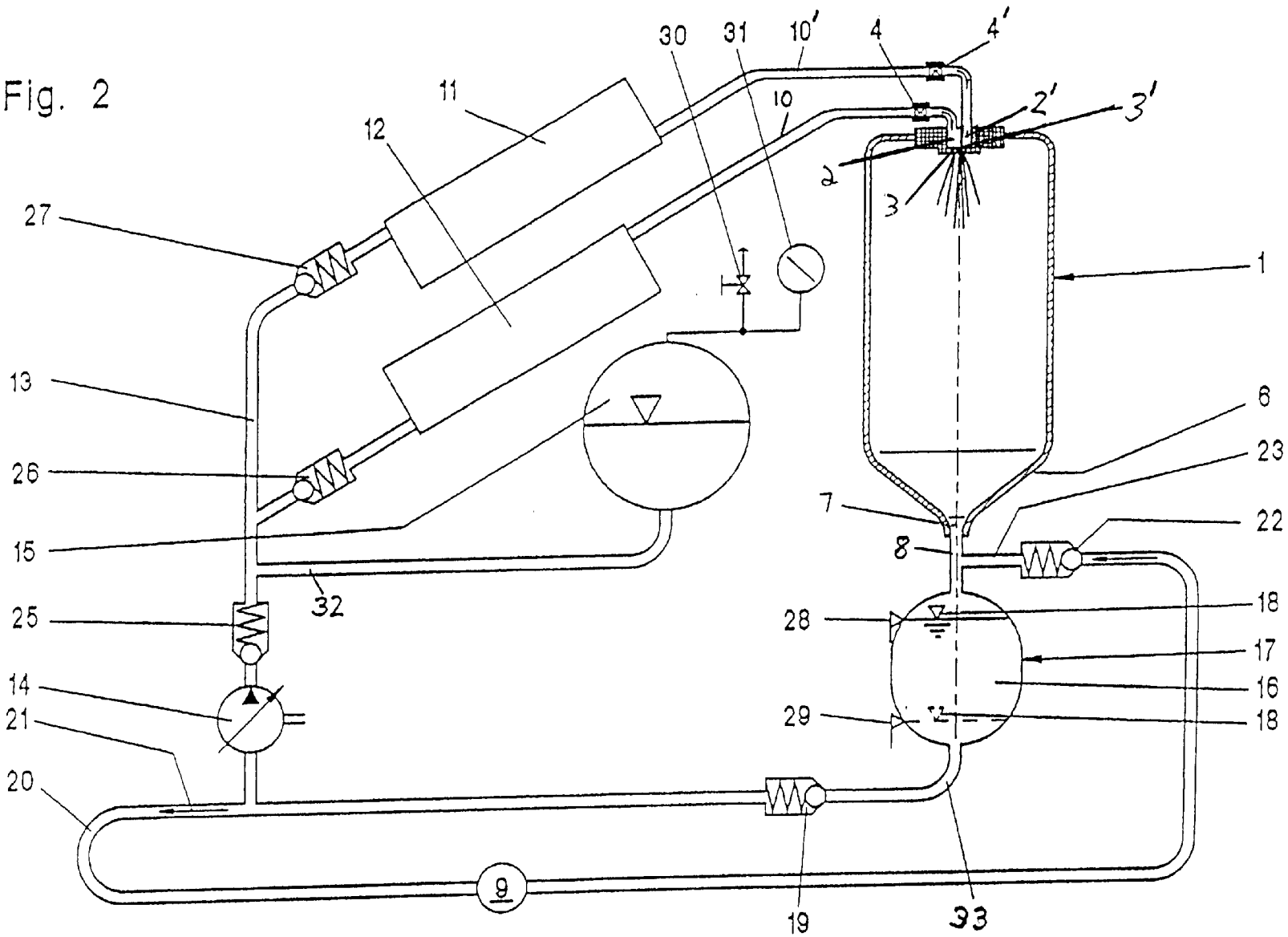
FIG. 2 shows an alternative version of the gas expansion apparatus according to FIG. 1.

The valves 4 and 4' are assigned to the pressure vessel 1 according to FIG. 2 on its top side, one valve 4' being coupled via a connecting line 10' to a cooling device 11 for generating the cold water and the other valve 4 being coupled likewise via a connecting line 10 to a heating device 12 for generating the hot water. The hot water enters an injection orifice 2, which has an associated spray and atomizer nozzle 3. Similarly, the cold water enters an injection orifice 2', which has an associated spray and atomizer nozzle 3'.

The cooling device 11 and the heating device 12 are fed by a pump 14 via an appropriately branching line 13, the line 13 being connected to a compensating vessel 15. A nonreturn valve 27 is inserted into the line 13 directly upstream of the cooling device 11, and a nonreturn valve 26 is inserted into the line 13 directly upstream of the heating device 12. The nonreturn valves 27 and 26 prevent the appropriately thermally controlled water from flowing out of the cooling device 11 and out of the heating device 12. Furthermore, a nonreturn valve 25 is provided in line 13 between the pump 14 and an inflow 32 of the compensating vessel 15. In order to fill the entire system with water, the compensating vessel 15 is connected to a corresponding water supply via an inflow valve 30. Moreover, the compensating vessel 15 is coupled to the pump 14 via a pressure sensor 31.

Arranged on the underside of the pressure vessel 1, below the sump 7, according to FIG. 2 is a liquid piston pump 17 which is filled with water 16 and which is connected on the inlet side to the water outflow orifice 8 of the pressure vessel 1, said orifice being coupled to a water inflow 23 of the working circuit 20, and on the outlet side to a water outflow 33 of the working circuit 20. During the expansion of the gaseous medium in the interior of the pressure vessel 1, that is to say during the injection of hot water, the water 16 is subjected to pressure correspondingly in the liquid piston pump 17 and the level 18 assumes a lower end position monitored by a level sensor 29 which controls the end of the injection phase of the hot water. In this case, a first working circuit nonreturn valve 19 assigned to the water outflow orifice 8 is opened, and the generated pressure is propagated in the water circuit 20 in the direction of the arrow 21. During the build-up of pressure in the working circuit 20, a second working circuit nonreturn valve 22 in a water inflow 23 arranged between the pressure vessel 1 and the liquid piston pump 17 is closed, said nonreturn valve being opened at a later time, to be precise during the contraction of the gaseous medium in the interior of the pressure vessel 1, in order to feed the medium 16 into the liquid piston pump 17 and to form the working circuit 20.

During the contraction of the gaseous medium in the interior of the pressure vessel 1 as a result of the injection of cold water, the nonreturn valve 19 assigned to the water outflow orifice 8 is closed, and the level 18 of the medium 16 of the liquid piston pump 17 assumes an upper end position which is likewise monitored by a level sensor 28. After a corresponding signal has been given by the level sensor 28, the injection phase of the cold water is terminated.

During the flow through the working circuit 20, the water 16 drives the arrangement 9, connected into the working circuit 20, for the conversion of the thermal energy. Liquid media other than water 16 may, of course, also be used for operating the working circuit 20.

The condensate or outflowing water occurring in the pressure vessel arrives, via the liquid piston pump 17, at the working circuit 20 which is coupled to the pump 14 which, in turn, by means of corresponding control by the pressure sensor 31 of the compensating vessel 15, supplies the outflowing water to the cooling device 11, the heating device 12 and the compensating vessel 15.

To control the sequences, the valves 4, the level sensors 28 and 29 of the liquid piston pump 17, the pressure sensor 31 of the compensating vessel 15 and/or the pump 14 may be coupled to a computer, not illustrated, which monitors the injection operations, the level 18 and the pressure and correspondingly activates the components listed above.

What is claimed is:

1. A gas expansion apparatus, comprising:

a closed hollow pressure vessel including an injection nozzle located at an upper end of said pressure vessel for injection of a first liquid and of a second liquid into said pressure vessel, said first liquid being at a higher temperature than said second liquid;

a sump located at a lower end of said pressure vessel, said sump having a substantially smaller diameter than that of said pressure vessel and projecting downward therefrom;

a controllable liquid outflow pipe located at said lower end of said sump;

a liquid displacement pump having a gas/liquid interface and an inlet and an outlet, said inlet of said pump being connected to said controllable liquid outflow pipe; and, a working circuit for driving a thermal energy conversion device, said working circuit having a liquid inflow connected between said controllable liquid outflow pipe and said thermal energy conversion device, and said working circuit having a liquid outflow connected between said outlet of said pump and said thermal energy conversion device, whereby injection of said first liquid into said pressure vessel causes gas contained within said pressure vessel to expand, driving the gas/liquid interface of said pump in a first direction to increase pressure on liquid in said working circuit, thereby driving said thermal energy conversion device, and injection of said second liquid into said pressure vessel causes the gas contained within said pressure vessel to contract, displacing said gas/liquid interface in a second direction opposite to said first direction.

2. The gas expansion apparatus of claim 1, wherein said injection nozzle comprises a spray and atomizer nozzle.

3. The gas expansion apparatus of claim 1, wherein an inner wall of said pressure vessel comprises at least one of a material that does not absorb heat and a coating of insulating material.

4. The apparatus of claim 1, wherein said inner wall of said pressure vessel comprises at least one of a liquid-repelling material and a coating of liquid-repelling material.

5. The apparatus of claim 1, said liquid displacement pump provided with level sensors for detecting a lower level of liquid at a lower end position with said liquid displacement pump and for detecting an upper level of liquid at an upper end position within said liquid displacement pump.

6. The apparatus of claim 1, further comprising:

a first working circuit nonreturn valve located within said working circuit liquid outflow; and, a second working circuit nonreturn valve located within said working circuit liquid inflow.

7. The apparatus of claim 1, said pressure vessel having a lower portion in form of a funnel which merges into said sump.

* * * * *